US006270447B1

(12) United States Patent
La Placa

(10) Patent No.: US 6,270,447 B1
(45) Date of Patent: Aug. 7, 2001

(54) EXERCISE DEVICE AND METHOD OF USE

(76) Inventor: Jack La Placa, 681B Rte. 23 South, Pompton Plains, NJ (US) 07444

( * ) Notice: Subject to any disclaimer, the term of this patent is extended or adjusted under 35 U.S.C. 154(b) by 0 days.

(21) Appl. No.: 09/468,211

(22) Filed: Dec. 20, 1999

(51) Int. Cl.[7] ..... A63B 21/06
(52) U.S. Cl. ..... 482/100; 482/137; 482/139
(58) Field of Search ..... 482/100, 136, 482/137, 139

(56) References Cited

U.S. PATENT DOCUMENTS 5,263,915 * 11/1993 Habing ..... 482/100
5,769,757 * 6/1998 Fulks ..... 482/97

OTHER PUBLICATIONS

Swivel Grip (Brochure) RCVD in PTO Jun. 9, 1994.*

* cited by examiner

*Primary Examiner*—John Mulcahy
(74) *Attorney, Agent, or Firm*—Myron Amer P.C.

(57) ABSTRACT

Operating an exercise device using a weight-lifting arm thrust delivered similar to execution of a martial art karate maneuver, as permitted by rotatably mounted hand grips, and to the end of increasing the weight of the exercise resistance to the arm thrust.

1 Claim, 2 Drawing Sheets

EXERCISE DEVICE AND METHOD OF USE

The present invention relates generally to improvements in the construction of and in the operating mode of an exercising apparatus in which, more particularly, the improvements contribute to the exerciser being able to exert a greater force during the weight-lifting phase of an exercise routine, to thereby derive the benefit of using a correspondingly greater exercise weight than otherwise would be possible.

EXAMPLES OF THE PRIOR ART

It is already known, as exemplified by U.S. Pat. No. 4,563,003 for "Weight Lifting Apparatus Having Increased Force on the Return Stroke" issued to Bugallo et al. on Jan. 7, 1986, and U.S. Pat. No. 5,916,072 for "Exercise Apparatus With Multi-Exercise Press Station" issued to Webber on Jun. 29, 1999, that an exercising apparatus contemplates the use of arm thrusts to raise or lift an exercise weight and that this weight-lifting exertion by the exerciser is what primarily determines the exercising benefit to the exerciser. Stated somewhat differently, it is the typical circumstance that the greater the exercise weight that can be managed by the exerciser, the greater is the benefit, by way of muscle development or the like, which will accrue to the exerciser.

In the '003 and '072 patents, the hand grips that are engaged by the exerciser preparatory to making the noted arm thrusts are mounted to assume positions of movement that contribute to enhancing the exercisers ability to handle the exercise weight in use, such as imposing a proper wrist position in engaging a positioned hand grip, as best illustrated in FIG. 5 of the '003 patent, and in FIGS. 8–10 of the '672 patent, but this prior art hand grip positioning other than for the positioning of the exerciser's wrist or the like is not otherwise of any significant utility in the exercising use of the exercising apparatus of concern. Thus, the hand grip positioning does not contribute to the exerciser's ability to increase, without an increase in bodily physical strength, the exercise weight of an exercise routine.

Broadly, it is an object of the present invention to provide an exercising apparatus and mode of use thereof which overcomes the foregoing and other shortcomings of the prior art.

More particularly, it is an object to so construct and operate an exercising apparatus so as to use to advantage a greater force of a martial arts karate maneuver in the weight-lifting phase of operation of the exercising apparatus to contribute to use of a correspondingly greater exercising weight, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 2:
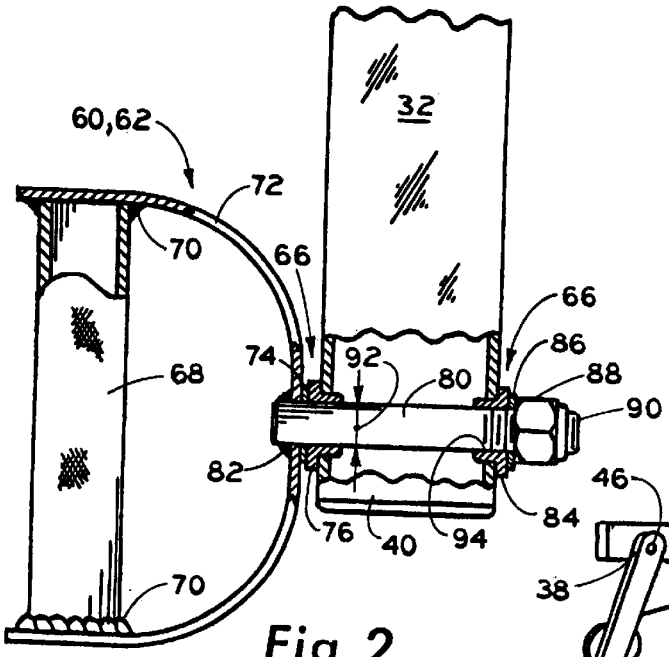
FIG. 2 is an isolated partially sectioned side elevational view of bearing means for mounting a hand grip for a rotational degree of movement of 360 degrees.

Method aspects of the present invention are concerned with increasing the exercise weight used during an exercise routine, and proposes to this end the use of a technique borrowed from Karate. More particularly, arm thrust 10, as illustrated in the drawn movement sequence of FIGS. 3, 4 and 5 which starts at a distance 12 in front of the exerciser 14 extends to the greater distance 16 coinciding with the length of the exerciser's arm 18. During this arm thrust of FIGS. 3, 4 and 5, the exerciser is provided with the option of executing a rotational position change 20 in his/her fist 22, as best illustrated in FIG. 4.

Figure 3:
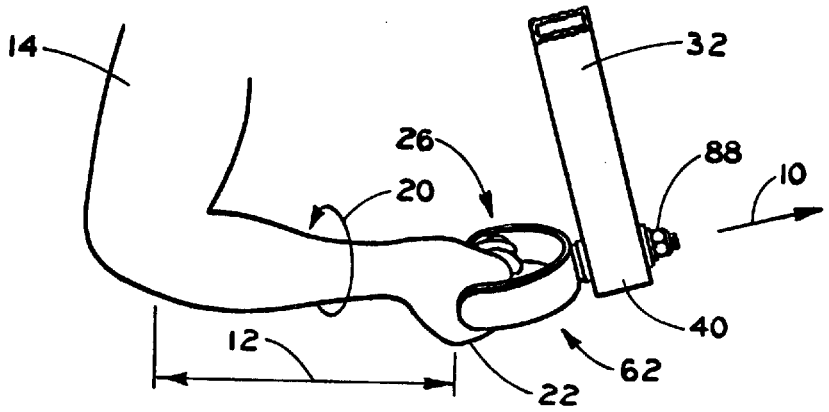
FIGS. 3, 4 and 5 are partial sequential views of arm positions illustrating an arm thrust for practicing the method of the present invention.
Figure 4:
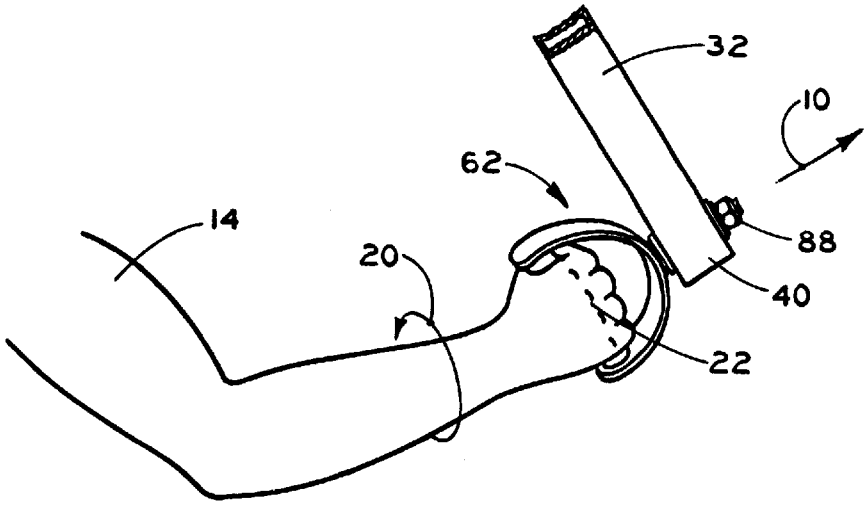
Figure 5:
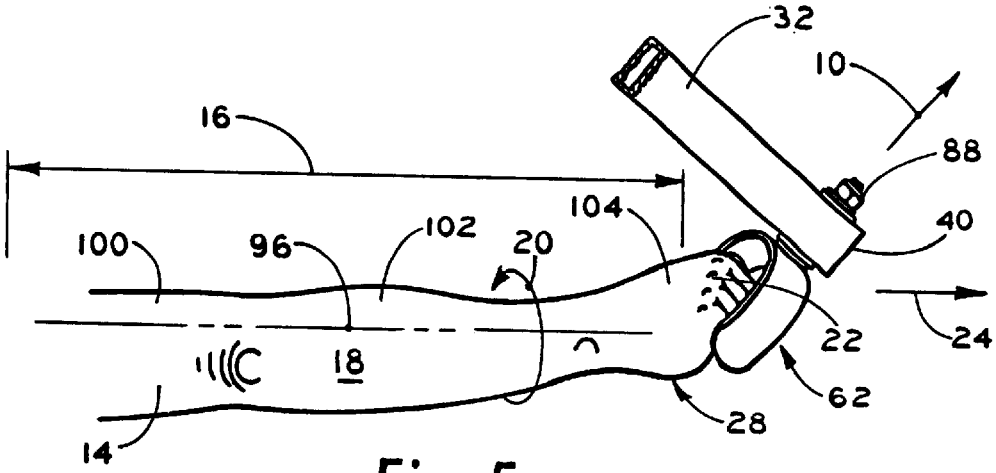

It is known by common experience that the described arm thrust is used in practicing the martial art of Karate and that the position change 20 is understood to effectively increase the force 24 of the arm thrust 10 and can start with a palm's up position, as noted at 26 in FIG. 3, and end with a palm's down condition, as noted at 28 in FIG. 5, or using the starting and ending palm positions in reverse, it being only necessary that there be a 180 degree out-of-phase difference therebetween.

Figure 1:
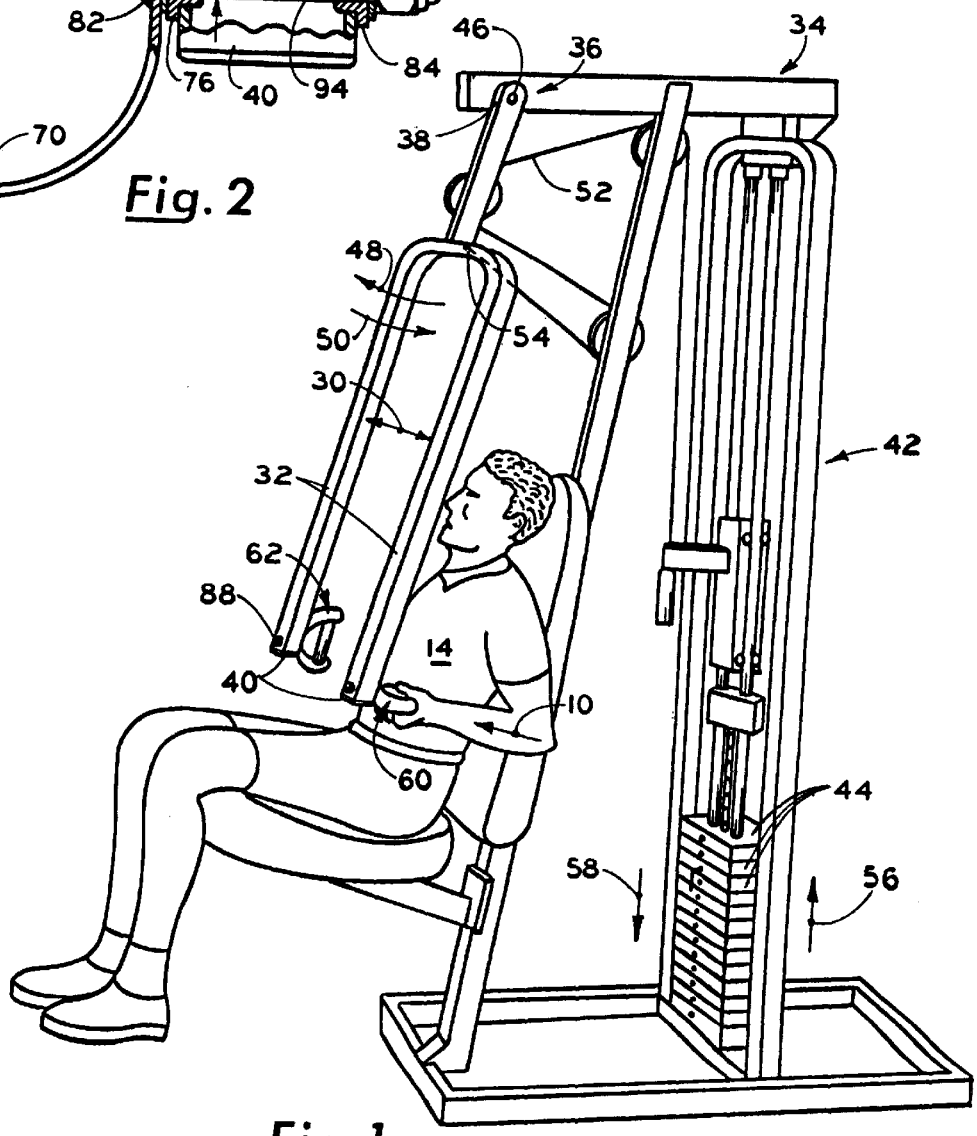
FIG. 1 is a perspective view of an exercising apparatus according to the present invention in which only the left hand of an exerciser is shown deployed on a cooperating left hand grip so as to more clearly illustrate a vertically oriented position of movement of a right hand grip.

Shown in FIG. 1 is the exerciser 14 seated in the clearance 30 between a preferred inverted U-shape with two similarly constructed and functioning operable members, individually and collectively designated 32. The U-shape is supported in a vertical orientation on support structure generally designated 34 at an attachment site 36 and each operable member 32 has an upper end 38 and a lower end 40. The U-shape configuration is preferred because it does not obstruct the vision of the exerciser 14 of the surrounding environment, but it is to be understood that a single centrally located operable member (not shown) can be readily used when an obstruction of the exerciser's view is of no consequence.

Shown in FIG. 1 and serving as background of the present invention, is exercising apparatus, generally designated 42, of a type having a known exercising operational mode in which a selected one or more of an exercise weight 44 is raised or lowered in response to pivotal traverses of the operable member 32. To this end, the operable member 32 adjacent its upper end 38 is pivotally mounted, as at 46, so as to partake of pivotal traverses in clockwise and counterclockwise directions 48 and 50.

A cable means, generally designated 52, is connected from the exercise weight 44 to an attachment site below the pivot 46, as at 54, so that a clockwise pivotal traverse 48 of the operable member 32 urges the exercise weight 44 in ascending movement 56, and a counterclockwise pivotal traverse 50 permits the exercise weight 44 to be lowered in movement 58 under its own weight.

Although bearing means involved in the mounting of the left and right hand grips 60 and 62 adjacent the bottom end 40 of the operable member 32 should be well known and understood by those well versed in apparatus construction, but not heretofore used in exercising apparatus construction, for completeness' sake a preferred bearing means, generally designated 66, is shown in FIG. 2, to which reference should now be made.

Each hand grip 60, 62 per se is a diamond knurled steel tube 68 with a fillet weld around the tube, as at 70, and connected to extend across the opening of a semi-circular hand guard 72. A steel washer 74 and a bronze shouldered bushing 76 are aligned with each other and disposed about an end 78 of a threaded steel shaft 80, the inboard end of which is projected through the aligned washer and bushing 74, 76 and welded to the closed end of the hand guard 72, as at 82. The outboard end of the shaft 80 is similarly projected through an aligned bushing and washer 84, 86 being seated in an opening in the operable member 32 and held in place by an elastic stop nut 88 in threaded engagement with threads 90. The diameter 92 of the shaft 80 is selected to be slightly undersized with respect to the diameter of the opening 94 of the bushings 76, 84 so that the size differences provide a rotating clearance for a rotational degree of movement, as depicted in FIG. 4, of a hand grip 62 relative to the operable member 32 for a full 360 degrees.

It is believed that the increase in the force 24 is attributable to the linear alignment 96 of the exerciser's upper arm 100, lower arm 102, wrist 104 and fist 22, as depicted in FIG. 5.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In the exercising mode of operation of an exercise device during which the arms of a user are thrust forwardly from a close starting position to a spaced clearance position against the resistance of an exercise weight, the improvement consisting of a method of increasing the force of said arm thrusts comprising the steps of:

a) using right and left operable members each having a distal end and a proximal end;

b) pivotally mounting said distal ends so that each said operable member partakes of a pivotal traverse;

c) operably connecting said right and left operable members by a cable to an exercise weight means so that each said pivotal traverse is against the resistance of an exercise weight;

d) providing a seat so that a seated exerciser is in reach of said proximal ends of said operable members;

e) mounting in a horizontal orientation each of a right and left pair of handgrips, respectively, on said proximal ends of each of a said operable member; and f) embodying a bearing in an interposed position between a said handgrip mounting and a said end of a said operable member effective to provide a 360 rotational degree of movement in each said handgrip; and g) instructing an exerciser grasping said handgrip to start an arm thrust in a palms-up condition and during said arm thrust to rotate into a palms-down condition to thereby increase the force overcoming the resistance of the exercise weight.

* * * * *